US005290035A

United States Patent [19]

Hannon et al.

[11] Patent Number: 5,290,035

[45] Date of Patent: Mar. 1, 1994

[54] BALANCED GOLF PUTTER

[76] Inventors: Richard H. Hannon, 2794 Loker Ave. #105, Carlsbad, Calif. 92008; Jacob H. Schmidt, 119A Kilkenny St., Cardiff, Calif. 92007

[21] Appl. No.: 872,510

[22] Filed: Apr. 23, 1992

Related U.S. Application Data

[63] Continuation-in-part of Ser. No. 697,397, May 9, 1991, abandoned.

[51] Int. Cl.[5] ..... A63B 53/04

[52] U.S. Cl. ..... 273/167 F; 273/167 H; 273/167 G

[58] Field of Search ..... 273/77 R, 81 A, 81 R, 273/80 R, 80 A, 167-175

[56] References Cited

U.S. PATENT DOCUMENTS

| | | | |
|---|---|---|---|
| 3,042,405 | 7/1962 | Solheim | 273/78 |
| 3,387,844 | 6/1968 | Shippee | 273/167 H |
| 3,497,220 | 2/1970 | Scott | 273/80 C |
| 3,625,517 | 12/1971 | Durnack | 273/167 F |
| 3,652,093 | 3/1972 | Reuter, Jr. | 273/167 H |
| 3,679,207 | 7/1972 | Florian | 273/81 A |
| 3,954,265 | 5/1976 | Taylor | 273/80 C |
| 4,203,598 | 5/1980 | Stuff et al. | 273/81 A |
| 4,655,459 | 4/1987 | Antonious | 273/167 H |
| 4,872,683 | 10/1989 | Doran et al. | 273/167 H |
| 5,078,398 | 1/1992 | Reed et al. | 273/167 G |

FOREIGN PATENT DOCUMENTS 0294107 12/1988 European Pat. Off. ..... 273/80 A

*Primary Examiner*—Vincent Millin
*Assistant Examiner*—Steven B. Wong
*Attorney, Agent, or Firm*—Frank D. Gilliam

[57] ABSTRACT

A golf club that produces a smoother stroke, does not attempt to turn in the golfer's hands, and provides superior feedback to the golfer comprises a putter head, a shaft, and a grip. The putter head comprises an elongated body having a toe end, a heel end, a fore side including a ball striking face, an aft side opposite said fore side, a sole, and a top side. A longitudinal axis runs heel to toe parallel with the ball striking face. The head includes two chambers that increase the proportion of heel and toe mass relative to the center mass and decrease the transverse cross sectional area of head material and thereby increase vibration up an attached shaft upon ball impact. The chambers each exit the top side in a transverse slot. The transverse slots are approximately a ball width apart and equal distance on each side of the center of mass of said head. The entire putter is balanced so as to be more stable in a golfer's hands. A neutrally balanced putter has no moment about the shaft axis. A face balanced putter has weight distribution such that, when the putter may freely rotate about the shaft axis, the putter will come to rest with the head longitudinal axis level.

6 Claims, 1 Drawing Sheet

BALANCED GOLF PUTTER

REFERENCE TO RELATED APPLICATION

This application is a continuation-in-part of co-pending application Ser. No. 697,397, now abandoned filed May 9, 1991.

BACKGROUND OF THE INVENTION

1. Field of the Invention

This invention relates in general to a golf club for putting on a green and more particularly to a putter specifically balanced for more controlled hitting. The putter includes a putterhead, a shaft portion attached to the putterhead including a grip attached to the upper end of the shaft.

2. Background of the Invention

A golfer requires more accuracy when putting on the green than at any other time during the game because, during putting, the target is a hole approximately four and one half inches in diameter. To achieve this accuracy, a golfer must use a club so constructed as to provide maximum resistance to putter rotation during the stroke and at moment of impact.

To this end, it is a principal object of this invention to provide a golf putter that has a zero rotation point within the striking face at the sweet spot when the striking face makes contact with the golf ball.

Another principal object if to provide a golf putter that does not promote a tendency to open or close at anytime during the golfer's putting stroke.

Also, the feedback that a golfer receives while moving a golf putter and while striking a ball is very important.

It is desirable to have a putter head that transfers a greater amount of feedback vibration up the shaft to the golfer.

It is desirable to have a putter head with a better indicator for alignment to the ball.

SUMMARY OF THE INVENTION

Broadly speaking the invention is a golf putter that produces a smoother stroke, does not attempt to turn in the golfer's hands, and provides superior feedback to the golfer.

According to the invention, a putter comprises a putter head, a shaft, and a grip. The putter head comprises an elongated body having a toe end, a heel end, a fore side between the heel end and toe end including a ball striking face, an aft side opposite said fore side, a sole, and a top side. A longitudinal axis runs heel to toe parallel with the ball striking face.

The head includes a bore for attaching the putter shaft to the body such that the line of the shaft axis passes substantially through the center of mass of the head.

In a preferred embodiment, the body includes two chambers entering the body from the sole. One Chamber is located on the heel side of the center of mass and one chamber is located on the toe side of the center of mass. The chambers increase the proportion of heel and toe mass relative to the center mass and decrease the transverse cross sectional area of head material and thereby increase vibration up an attached shaft upon ball impact. The chambers each exit the top side in a transverse slot. The transverse slots are approximately a ball width apart from each other and equal distance on each side of the center of mass of said head.

The entire putter is balanced so as to be more stable in a golfer's hands. A neutral balanced putter has no moment about the shaft axis. A face balanced putter has weight distribution such that, when the shaft is laid across two parallel balance edges, the putter will come to rest with the longitudinal axis level.

The balanced putter of the invention also provides superior feedback to the golfer upon striking the ball, and is superior in visual alignment to the ball.

Other features and many attendant advantages of the invention will become more apparent upon a reading of the following detailed description wherein like reference numerals refer to like parts throughout.

DETAILED DESCRIPTION OF THE INVENTION

Figure 1:
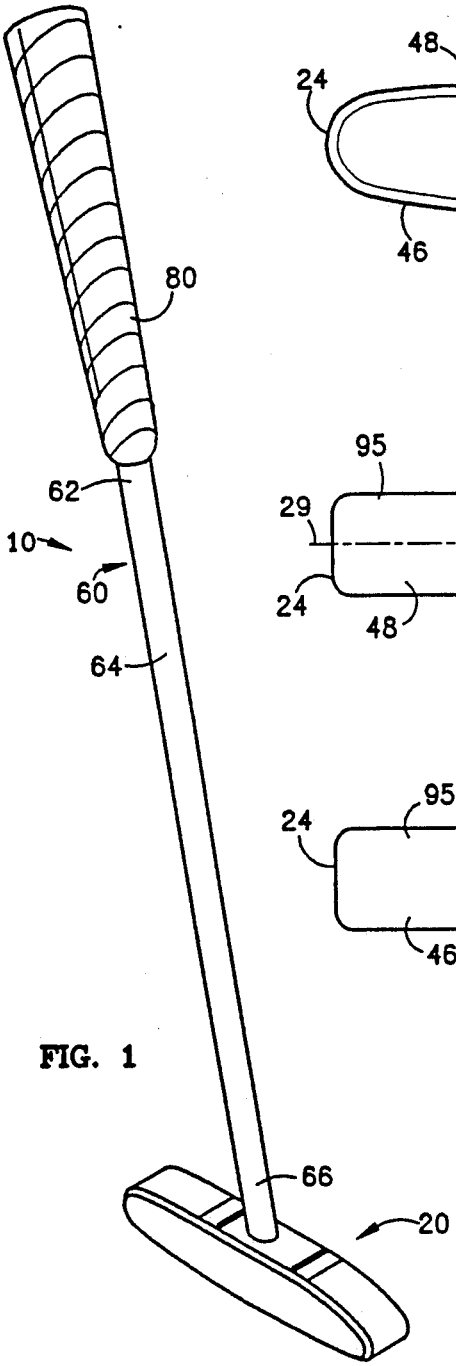
FIG. 1 is a perspective view of a preferred embodiment of the golf putter of the invention.

With reference now to the drawings, and more particularly to FIG. 1 thereof, there is shown a perspective view of a preferred embodiment of the balanced golf putter, denoted generally as 10, of the present invention.

The putter generally comprises a putting head, denoted generally as 20, and a shaft portion comprising a substantially straight shaft, denoted generally as 60, and a grip, denoted generally as 80. The terms golf club or putter as used herein is defined to mean the total club or putter including any other attachment, such as a hosel which may be used to attach a shaft to a head and is considered part of the shaft portion.

Figure 6:
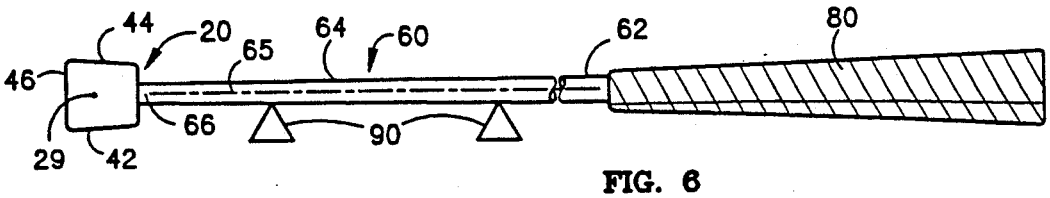
FIG. 6 is a view of the putter of FIG. 1 showing the head position of the balanced putter when the shaft is laid over a pair of parallel balance beams.

Shaft 60 is typically a hollow metal cylinder having a lower end 62 to which grip 80 is attached. Shaft 60 typically tapers slightly in diameter from upper end 62 to lower end 66 where it is attached to head 20. The central portion 64 of shaft 60 is substantially straight and has a shaft axis 65, as seen in FIG. 6.

Figure 2:
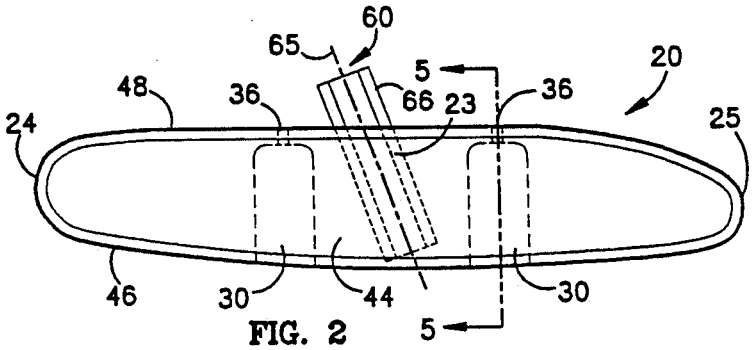
FIG. 2 is a side elevation view of a preferred embodiment of the putter head and shaft mounting.
Figure 3:
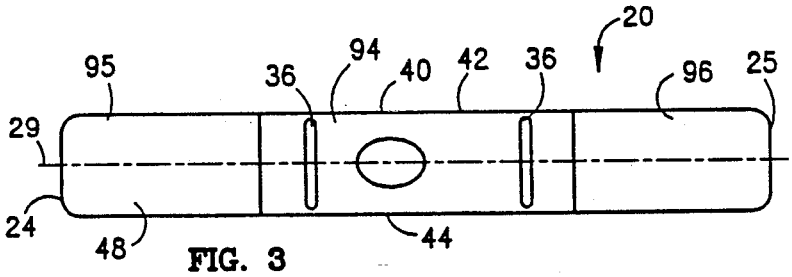
FIG. 3 is a top view of the putter head of FIG. 2.
Figure 4:
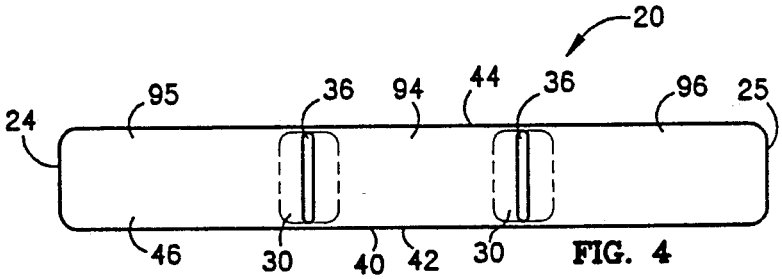
FIG. 4 is a bottom view of the putter head of FIG. 2.
Figure 5:
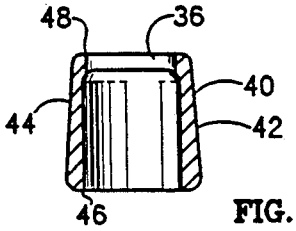
FIG. 5 is sectional view taken on line 5—5 of FIG. 2.

With reference now to FIGS. 2-5 there is shown a preferred embodiment of the putter head 20 of the present invention. FIG. 2 is side elevation view of putter head 20 also showing shaft lower end 66. FIG. 3 is a top view of the putter head 20 of FIG. 2. FIG. 4 is a bottom view of the putter head 20 of FIG. 2. FIG. 5 is sectional view taken on line 5—5 of FIG. 2.

Putter head 20 has an elongated, generally rectangular shaped body 22, typically comprised of metal, such as brass or 6061 T6 aluminum. Shaft 60 is attached to body 22 at an angle by means such as slanted bore 23. The end of body 22 under shaft 60 is designated the heel end, denoted generally as 24, the other end is designated the toe end, denoted generally as 25. Typically, the heel end 24 of putter head 20 is closest to the golfer during use.

Along one side of body 22 between the heel 24 and toe 25 is a fore side, denoted generally as 40, including a golf ball striking face 42. The other side between heel 24 and toe 25 is designated aft side 44. The bottom side is designated as sole 46; the upper side is designated as top side 48. The putter head sides 40, 44, 46, 48 have generally smooth planar surfaces. A heel/toe axis or longitudinal axis 29 passes from heel to toe parallel with ball striking face 42.

Chambers, denoted generally as 30, are disposed in body 22 toward the heel 24 and toward the toe 25 from the attachment of shaft 60. In the preferred embodiment, a portion of chambers 30 exit top side surface 48 as slots 36. Slots 36 increase the vibrational resonance of chambers 30 by decreasing the mass supporting the heel and toe masses toward the heel and toe from chambers 30 and further decreasing the stiffness of head 20. Slots 36 also act as ball alignment slots visible to the golfer. Preferably, slots 36 are the width of a golf ball apart from each other.

Shaft 60 attaches at an angle of 10 degrees or greater; preferably of 12–24 degrees. Shaft 60 is attached to body 22 such that the line 65 of the shaft axis passes substantially through the center of mass of head 20.

Head 20 of the preferred embodiment is approximately 4.5 inches in length, 0.625 inches wide at the top and 0.6875 inches wide at the bottom and 0.8975 inches height. Sole 46 is concave upwards longitudinally with a radius of 7.5 inches. The heel and toe ends are radiused to fair sole and top side. Chambers 30 open at the bottom onto sole 46 and are 0.6250 inches wide fore/aft, 0.375 inches wide heel/toe, and 0.7875 inches in height below alignment slots 36 with rounded corners of 0.125 radius. Slots 36 are 1.00–1.68 inches apart and are 0.0625 inches wide and 0.625 inches long. Fore and aft sides 42,44 are tapered upward by four degrees. Sole 70 is concave upwards transversely with a radius of 12 inches. Fore and aft sides 42,44 fair with top side 48 with a radius of 0.0625 inches. A typical shaft bore is 0.355 inches. A typical putter head has a weight of 308 grams. The entire shaft 90 typically weighs about 3.5 ounces.

As seen in sectional view in FIG. 5, chambers 30 occupy almost the entire cross-sectional area of head 10 at the chamber location. Chambers 30 may be thought to divide head 10 into three sections: a central mass section 94 between chambers 36 and outer mass sections 95, 96. Outer mass sections 95,96 constitute the majority of the mass of head 20.

Chambers 36 have two principal roles. First, they move mass outward. Moving the mass outward creates greater resistance to rotation of head 10 if the ball is not struck directly on the center of momentum. Thus, head 20 tends to stay in its original alignment and still propel the ball in the intended direction even if striking the ball off the sweet spot.

Second, chambers 30 increase vibration to the shaft 90. The increased vibration is felt by the golfer. This increased vibration felt by the golfer contributes to the golfer's feedback from the putt and combined with the other factors, such as muscle feedback, speed of the stroke, and speed and direction of the struck ball, significantly helps the golfer improve subsequent putts. It is thought that the vibration is increased because the chambers 36 remove much of the connective mass that can transfer shock between the central mass 94 and outer masses 95,96.

Alignment slots 36 pass completely through head 10. Alignment slots 36 further increase feedback vibration to shaft 90 by further reducing the connection area between central mass 94 and outer masses 95,96 and serve to align the putter head 10 to the target line. The slots are apart about the width of a golf ball.

The inventors have discovered that a neutrally balanced or a face balanced putter provide a superior stroke in comparison to conventional putters. According to the invention a neutrally balanced putter is defined as a putter having no moment about the shaft axis. In its simplest form, a neutral balance putter has a shaft portion having its center of mass on the shaft axis and the line of the shaft axis passes through the center of mass of the head. For example, this can be achieved with a head that is a rectangular parallelepiped and a symmetrical circular shaft that passes through the center of the head.

In another idealized form, the neutrally balanced putter head has weight distribution symmetry about a fore/aft vertical plane and has weight distribution symmetry about a heel/toe vertical plane, and the shaft has no moment about its axis and passes through the mass center of the head.

With reference now to FIG. 6, there is shown one method of balancing a putter according to the invention. The putter 10 of FIG. 1 is shown in the balancing position with shaft 60 horizontal and lying over two balance beams 90 such that putter 10 can be freely rotated on the beams 90. Ideally, beams 90 can be considered two frictionless support lines that support the putter and allow putter 10 to be freely rotated about shaft axis 65. In practice, beams 90 may be triangular prisms. For this discussion, the shaft is considered to be cylindrical or supported by the beams 90 at cylindrical locations, otherwise, and in the alternative, for the balancing test the club could be supported, such as by pins, in each end of the shaft axis so that the club can freely rotate about the shaft axis..

When placed on balance beams 90, the neutrally balanced putter has no tendency to rotate if undisturbed and has no preference for stopping position if disturbed. This is because the center of mass of the neutral balance putter is on the shaft axis.

Putter 10 shown is face balanced, i.e. the total weight of putter 10 is distributed such that, when the club is supported so that it can rotate freely about the shaft axis, the longitudinal axis of the head will be level. In the balancing position shown in FIG. 6, face balanced putter 10 will come to rest in the position shown in FIG. 6 with longitudinal axis 29 being level, i.e. horizontal or normal to the gravity vector. A face balanced putter has its center of mass directly in the direction of one of the two faces from the shaft axis. Preferably, the striking face 42 will be downward facing. In this case, the center of mass of said club is directly in the direction of the striking face from the shaft axis.

Several methods may be used to balance putter 10. The preferred method comprises constructing a putter 20 substantially as dimensionally described above with the axis of a straight shaft 60 passing substantially through the mass center of head 20. Grip 80 is attached to shaft 60. The putter is then supported as shown in FIG. 6. At this time, the putter will rotate until the center of gravity of the putter is at its lowest point. If longitudinal axis 29 is not level, weight is removed from the low end of putter head 20 by machining away a bit of the head until the head will lie level, i.e. balanced, in the balancing position. Conversely, weight could be added to the high end of the head 20. Of course, weight could be added or subtracted from the corresponding toe side or heel side of the shaft and/or grip, but making corrections at the heel and/or toe end of putter head 20 requires a smaller weight change because of their increased distance from the shaft axis 65.

Preferably, the faced balance putter has the center of mass of the putter directly between the shaft axis and the striking face as shown in FIG. 6 such that the striking face 42 ends up downward facing. A neutral balanced putter can be made a face balanced putter by adding or removing weight such that the center of mass is moved directly toward or away from the the striking face.

Weight can be added in any known form such as liquid, solid or powder, and weight can be removed by any suitable method such as machining, abrading, or creating cavities. Any combination of the above including both adding and deleting weight may be used.

Although a particular embodiment of the invention has been illustrated and described, various changes may be made in the form, construction, and arrangement of the parts herein, without sacrificing any of its advantages. Therefore, it is to be understood that all matter herein is to be interpreted as illustrative and not in any limiting sense and it is intended to cover in the appended claims such modifications and changes as come within the true spirit and scope of the invention.

As used in the following claims, the term golf "club" includes an entire club, i.e. a ball striking head and a shaft and anything attached thereto. The term "head" includes anything other than the shaft attached to the head. The term "shaft" includes anything other than the head attached to the shaft, e.g. a grip or hosel.

We claim:

1. A neutrally balanced golf putter which comprises:

an elongated head having heel and toe ends, a sole and opposite tope surface and opposed striking and aft faces;

a substantially straight shaft secured to said head at an angle to a line between said heel and toe ends and at substantially the geometric centers between said heel and toe and between said faces;

a gripping means on said shaft at the shaft end opposite said head;

two spaced, non communicating chambers in said head on opposite sides of said shaft, said chambers located so that the center of mass of the entire club lies on the longitudinal axis of said shaft; and wherein the size and spacing of said chambers is selected so that when said club is rotatably supported at two spaced points along said shaft said putter will rotate to balanced position with said head substantially horizontal.

2. The golf putter according to claim 1 wherein each of said chambers has a substantially uniform cross-section about a vertical axis, has a width sufficient to provide relatively thin walls between said chamber and said faces and is open at the sole surface; and further including a slot through said top surface communicating with said chamber, each slot lying substantially perpendicular to the striking face;

whereby increased vibration will be felt by a person holding said putter by said grip means when said striking face strikes a golf ball.

3. The golf putter according to claim 2 wherein said slots have lengths substantially equal tot he width of said chambers and are spaced apart a distance substantially equal to the width of a golf ball.

4. The method of making a neutrally balanced golf putter which comprises the steps of:

providing an elongated golf putter head having heel and toe ends, a sole and opposite top surface and opposed striking and aft faces;

securing a substantially straight shaft to said head at an angle to a line between said heel and toe ends and at substantially the geometric center between said heel and toe and between said faces;

applying grip means to the end of said shaft opposite said head;

forming two spaced, non-communicating, chambers in said head on opposite sides of said shaft, located so that the center of mass of the putter lies along the longitudinal axis of said shaft;

balancing said putter at two lines spaced longitudinally along said shaft; and modifying the volume of said chambers so that said putter rotates on said balance lines to come to rest with said head lying in a substantially horizontal plane.

5. The method according to claim 4 further including the step of forming a slot through the upper surface of said head in communication with each chamber, said slots oriented substantially perpendicular to said striking face.

6. The method according to claim 4 wherein said chambers are formed to a substantially uniform cross-section about a substantially vertical axis, with the chambers open at the sole surface and said chambers are sized to provide relatively thin walls between chambers and said faces;

whereby increased vibration is felt by a person when striking a golf ball with said putter head.

* * * * *